United States Patent [19]

Sato et al.

[11] 4,014,089

[45] Mar. 29, 1977

[54] METHOD OF CONNECTING BEAMS AND COLUMNS OF STEEL FRAME CONSTRUCTION

[75] Inventors: Kuniaki Sato, Hiratsuka; Kozo Toyama, Tokyo; Eiji Matsushita, Fujisawa; Akio Tomita, Tokyo; Shuei Suzuki, Machida, all of Japan

[73] Assignees: Kajima Corporation; Hitachi Metals, Ltd., both of Tokyo, Japan

[22] Filed: Dec. 8, 1975

[21] Appl. No.: 638,614

Related U.S. Application Data

[63] Continuation-in-part of Ser. No. 551,914, Feb. 21, 1975, Pat. No. 3,938,297.

[52] U.S. Cl. ..... 29/526; 228/138; 228/140

[51] Int. Cl.[2] ..... B23P 19/00

[58] Field of Search ..... 29/526, 155 R; 228/138 X, 140 X; 403/406, 312, 187, 189; 52/758 F, 758 B, 758 R, 760

[56] References Cited

UNITED STATES PATENTS

| | | | |
|---|---|---|---|
| 1,102,502 | 7/1914 | Hansbrough | 403/187 |
| 2,201,826 | 5/1940 | Ditchfield | 52/758 R X |
| 2,374,550 | 4/1945 | McIntosh | 403/189 X |
| 3,591,214 | 7/1971 | Gallay | 52/758 F |
| 3,661,048 | 5/1972 | Judd | 52/758 F X |
| 3,840,124 | 10/1974 | Atwater | 29/526 X |

FOREIGN PATENTS OR APPLICATIONS

| | | | |
|---|---|---|---|
| 654,930 | 1/1938 | Germany | 403/187 |
| 517,107 | 1/1940 | United Kingdom | 403/312 |

*Primary Examiner*—Charlie T. Moon

[57] ABSTRACT

A method of connecting beams having an H-shaped section to a column having an H-shaped section of a steel frame construction with upper and lower flange fittings. The flange fitting comprises a substantially rectangular base plate to be connected to the column having centrally a continuous thicker portion from which the base plate is tapered toward opposite ends of the base plate, a supporting plate projecting from the thicker portion for supporting a flange of the beam and a reinforcement on the base plate forming a T-shaped portion with the supporting plate. First the supporting plate of the upper flange fitting is secured to one end of an upper flange of the beam in end-to-end relationship and the base plate of the lower flange fitting is bolted in position to the column. Thereafter, one end of a lower flange of the beam is located onto the supporting plate of the lower flange fitting, and the lower flange of the upper flange fitting are secured to the supporting plate of the lower flange fitting and the surface of the column, respectively.

9 Claims, 14 Drawing Figures

METHOD OF CONNECTING BEAMS AND COLUMNS OF STEEL FRAME CONSTRUCTION

This application is a continuation-in-part of copending application Ser. No. 551,914 filed on Feb. 21, 1975.

BACKGROUND OF THE INVENTION

1. Field of the Invention:

The invention relates to a method for connecting beams having an H-shaped section to a column having an H-shaped section.

2. Description of the Prior Art:

In prior art steel frame construction, T-shaped members each of which may be obtained by cutting H-shaped steel have often been used for connecting columns and beams. However, such T-shaped members are insufficient to transmit a shearing force acting on the beam to the column, so that a web of the beam must generally be connected to a flange of the column by means of separate joint members which would make the construction method complicated and expensive.

In another prior art steel frame construction, welding members of steel plate are welded to the flanges of the beam for connecting the column to the beam. In that case, however, the beam must be provided at corners between its flanges and web with notches required for welding operation. Accordingly, the notches make it insufficient to transmit a shearing force acting upon the beam to the column so that separate joint members are also required for the construction. Moreover after the plate members have been connected to the web of the beam by means of a fillet weld joint, the plate members may be deformed owing to stresses caused in welding which must be corrected by a troublesome method. If concentrated stresses acting upon the column from the flanges of the beam are relatively large, horizontal reinforcement plates must be welded between the flanges of the column for the purpose of a reinforcement of the construction.

In further prior art steel frame construction, columns and beams are directly connected by welding. In the connecting method, if heights of the beams gathered together at the column are not equal, horizontal reinforcement plates are required as in the prior art above described. It is usual to weld short length beams to the column in order to make it easy to transport the column from a factory to a field, but the transportation of the column having welded the short length beams is more difficult than that of single columns or beams, and such a column requires a troublesome operation for connecting the short length beams to more longer or standard beams with splice plates in the field. Moreover, there would be required bevelings at edges of the beams to be welded and notches at corners between the flanges and the webs of the beams which require a complicated working, and the webs of the beams are in intimate contact with the column for fillet welding, so that the edges of the beams to be welded should be worked with a sufficient high accuracy.

As described above, in the prior art, connections of columns and beams in steel frame construction generally required extra joint members and need complicated working and assemblies of the members and further have only low joint efficiency.

SUMMARY OF THE INVENTION

In order to overcome the above disadvantages in the prior art, according to the invention the method of connecting beams having an H-shaped section to a column having an H-shaped section of a steel frame construction by means of upper and lower flange fittings each comprising a substantially rectangular base plate to be connected to the column having centrally a continuous thicker portion from which the base plate is tapered toward opposite ends of the base plate, a supporting plate projecting from the thicker portion for supporting an upper flange of the beam and a reinforcement on the base plate forming a T-shaped portion with the supporting plate, characterized in comprising steps of securing the supporting plate of the upper flange fitting to one end of the upper flange of the beam in end-to-end relationship, bolting the base plate of the lower flange fitting in position to the column, placing one end of a lower flange of the beam onto the supporting plate of the lower flange fitting such that the base plate of the upper flange fitting secured to the upper flange of the beam is in contact with a surface of the column, securing the lower flange of the beam to the supporting plate of the lower flange fitting and bolting the base plate of the upper flange fitting to the surface of the column.

An object of the invention is to provide an improved method of connecting columns and beams of a steel frame construction capable of simplifying manufacture of steel frame members in a factory, transportation of the members and execution of works in building site to save the labor and to increase its efficiency and having a higher joint efficiency than that of the prior art to ensure an improved safety of the construction.

DESCRIPTION OF THE PREFERRED EMBODIMENTS

Figure 1:
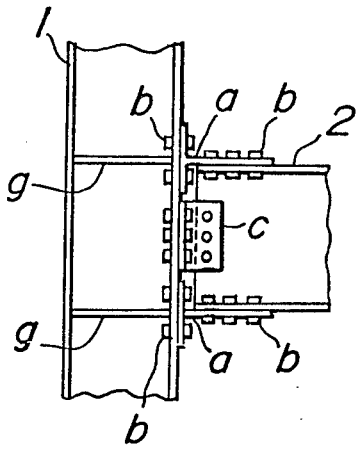
FIG. 1 is a side elevation of a connection of a column and a beam of a steel frame construction using T-shaped members in the prior art.
Figure 2:
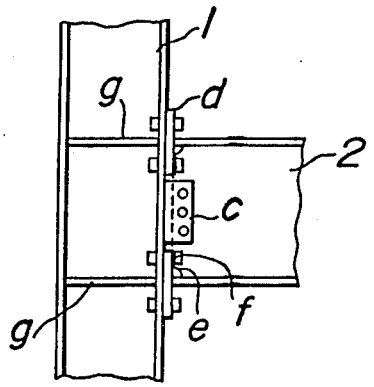
FIG. 2 is a side elevation of a connection of a steel frame construction using welding plate in the prior art.
Figure 3B:
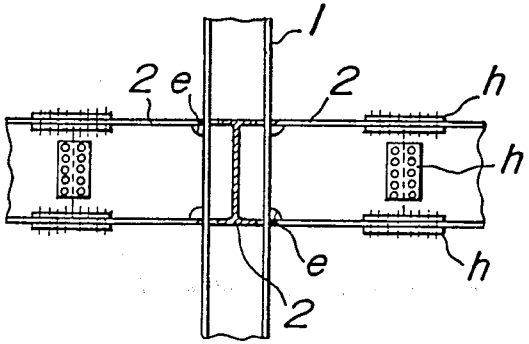
FIG. 3*b* is a front elevation of the portion of FIG. 3*a;*
Figure 3C:
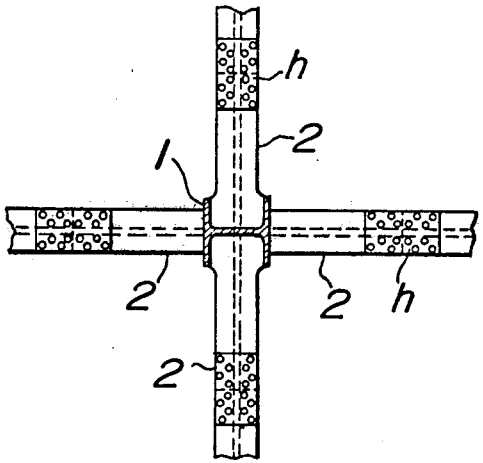
FIG. 3*c* is a plan view of the portion of FIG. 3*b;*
Figure 3A:
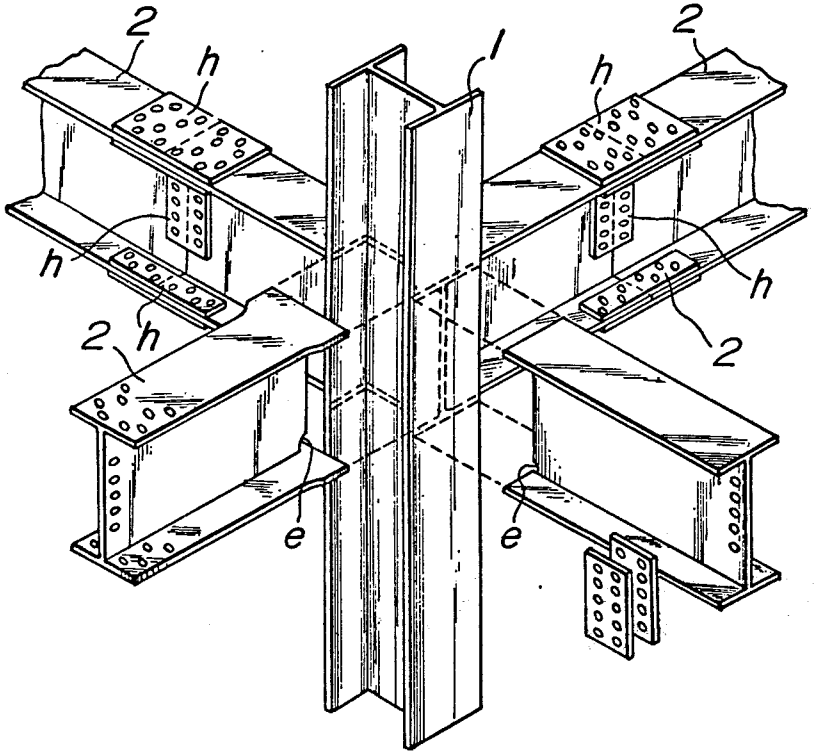
FIG. 3*a* is a perspective view of part of a steel frame construction directly connecting columns and beams in the prior art.

Referring to FIGS. 1–3, there are shown connections of columns 1 and beams 2 hitherto used. The connection shown in FIG. 1 utilizes T-shaped members *a* each of which may be obtained by cutting H-shaped steel or by welding steel plates.

The flanges of the beam 2 are fixed to the flange of the column 1 through the T-shaped members *a* connected to the flanges of the beam and the column by means of high strength bolts *b*. The T-shaped members are insufficient to transmit a shearing force acting upon the beam 2 to the column 1, so that a web of the beam 2 must generally be connected to the flange of the column by means of separate joint members *c* (FIG. 1).

Referring to FIG. 2, welding members *d* of steel plates are welded to the flanges of the beam 2. In the case, the beam must be provided with notches *e* at corners between the flanges and the web required for the welding operation. Accordingly, when the plate members *d* are connected to the web of the beam 2 by means of a fillet weld joint *f*, the plate members *d* may be deformed or curved owing to stresses caused in welding which must be corrected by a troublesome method. Moreover, the notches *e* make it insufficient to transmit a shearing force acting upon the beam 2 to the column 1 so that joint members *c* are also required for the construction.

If concentrated stresses acting upon the column 1 from the flanges of the beam are relatively large, horizontal reinforcement plates *g* must be welded between the flanges of the column 1 for the purpose of a reinforcement of the construction.

It can be seen from the above description that the connections of columns and beams hitherto used in steel frame constructions require many joint members, and need complicated working and assemblies of the members and further have only low joint efficiencies.

In FIG. 3 showing further prior art, columns 1 and beams 2 are directly connected by welding. In the connecting method, if heights of the beams 2 gathered together at the column 1 are not equal, horizontal reinforcement plates *g* similar to those in FIGS. 1 and 2 are required. It is usual to weld short length beams to the column as shown in FIG. 3 to make it easy to transport the column from a factory to a field, but it requires a troublesome operation for connecting the short length beams to much longer or standard beams with splice plates *h* in the field. Moreover, there would be required bevelings at edges of the beams to be weld and notches *e* at corners between the flanges and the webs which require a complicated working, and the webs of the beams are in intimate contact with the column for fillet welding, so that the edges of the beams to be welded should be worked with a sufficient high accuracy.

As shown in FIG. 3, although short length beams are connected to the column to make it easy to transport these members, the transportation of the column having welded the short length beams is more difficult than that of single columns or beams.

The invention intends to eliminate these disadvantages in the prior art and provide a steel frame construction having a high joint efficiency without requiring any horizontal reinforcement plate or stiffener for columns and splice plate for beams and columns and without requiring any notches in the beams and any holes for bolts withstanding shearing stresses.

The embodiments of the invention for connecting H-shaped beams 2 to H-shaped column 1 will be explained referring to FIGS. 4–10.

Figure 5:
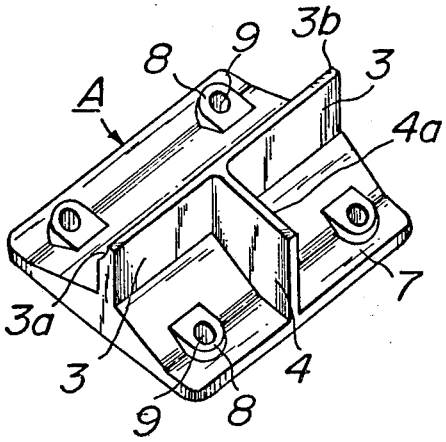
FIG. 5 is a perspective view of the upper flange fitting to be used for carrying out the invention.
Figure 6:
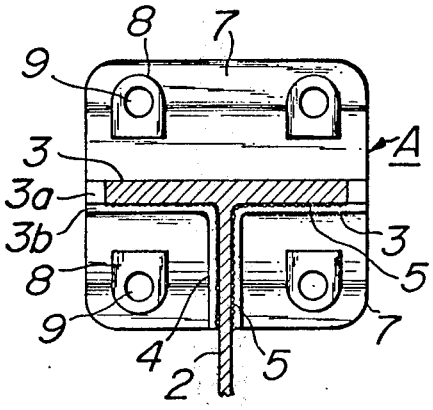
FIG. 6 is a front elevation of the fitting shown in FIG. 5 showing a section of a beam connected to the fitting.
Figure 7:
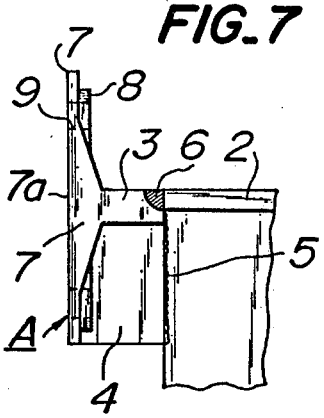
FIG. 7 is a side view of the fitting and part of the beam shown in FIG. 6.

Referring first to FIGS. 5–7 showing a fitting A for carrying out the invention for use in an upper flange of a beam, the fitting A is provided with a protrusion 3 which is horizontally extending in assembled position in a frame construction, adapted to be in opposition to the flange of the beam 2, which is formed along its one edge with a beveling 3*a* for butt welding with the flange of the beam. The fitting is further provided with a vertical protrusion or reinforcement 4 forming with the protrusion 3 a T-shaped portion or protrusion, the upper surface 4*a* of which has a width sufficient to be in contact with the web of the beam 2 for fillet welding and is flush with the upper surface 3*b* of the protrusion 3. Prior to the butt welding of the flange, the fillet welding portions 5 extend as shown in FIGS. 6 and 7 which may prevent a weld drip of the butt welding 6. A base plate 7 is tapered toward its opposite ends or upper and lower ends, of which gradient affects on the joint efficiency so that it should be determined depending upon a shape of the base plate and a yield strength and arrangement of the bolts. The plate 7 is formed with seats 8 each having a through hole 9 for a bolt to provide surfaces in close contact with the bolts or washers.

A surface 7*a* of the fitting which is adapted to be in contact with the flange or web of the column is generally flat mating with the surface of the flange or web. However, the surface 7*a* may be any configuration matching a surface of the flange or web, if it is uneven or curved. The fitting according to the invention is made as a unitary body by casting or drop-forging or a combination of rolling and welding or extruding and welding. In the combination of these workings, the seats 8 are made continuous in the direction of the horizontal protrusion so as to be able to form integrally by rolling or extruding or are separately welded to the fitting body and the reinforcement 4 is welded to the body.

Figure 8:
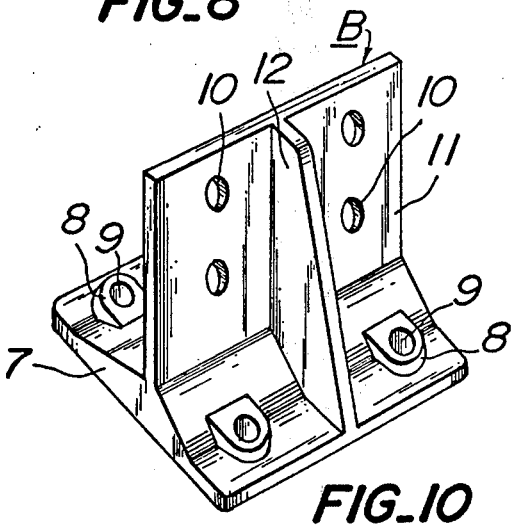
FIG. 8 is a perspective view of the lower flange fitting according to the invention.
Figure 9:
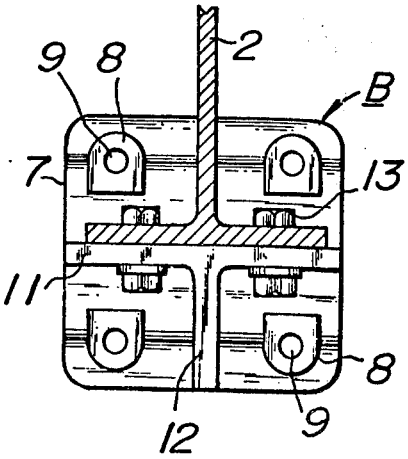
FIG. 9 is a front elevation of the fitting shown in FIG. 8 showing a section of a beam bolted thereto.
Figure 10:
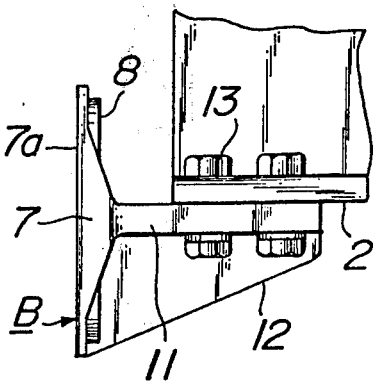
FIG. 10 is a side view of the fitting and the part of the beam shown in FIG. 9.

FIGS. 8–10 show another fitting B for carrying out the invention for use in a lower flange of a beam, wherein the same reference numerals as in the fittings A have been utilized to identify like part.

The fitting B is provided with a supporting or extending plate 11 formed with holes 10 for bolts by means of which the lower flange of the beam supported on the horizontal plate is bolted thereto. The fitting B is further provided with a reinforcement plate 12 extending substantially perpendicular from the supporting plate 11 to form a T-shaped shelf. A base plate 7 is tapered from the bottom of the supporting plate 11 toward the opposite ends or upper and lower ends and is formed with seats 8 each having a through hole 9 for a bolt. The fitting is made as a unitary body by casting or drop-forging or a combination of rolling and welding or extruding and welding.

The protrusion 3 of the fitting A and the plate 11 of the fitting B are not necessarily perpendicular to the surfaces 7*a* of the fittings A and B, respectively. The protrusion 3 and the plate 11 may be inclined upwardly or downwardly, if desired.

The method of connecting a column and beams by means of the fittings will be explained hereinafter.

Figures 4A, 4B, 4C:
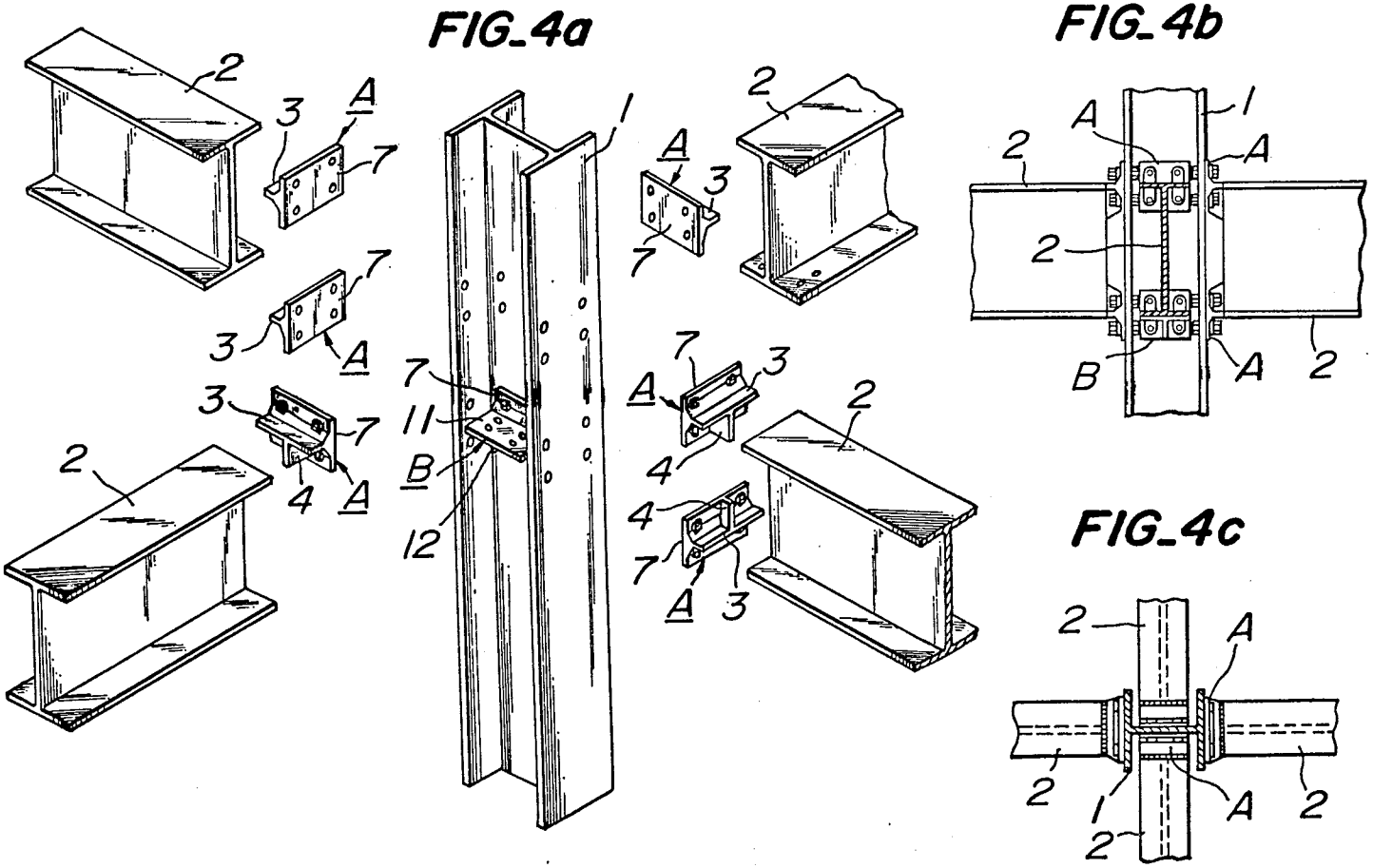
FIG. 4*a* shows the method of connecting a column with beams according to the invention.
FIG. 4*b* is a front elevation of the connection shown in FIG. 4*a;*
FIG. 4*c* is a plan view of the connection shown in FIG. 4*a;*

In case of connecting a beam to a flange of a column, two fittings A are symmetrically in opposition to each other, one upon the other, as shown at the upper left hand and lower right hand in FIG. 4*a*, of which reinforcement 4 are connected to edge surface of the web of the beam 2 by butt welding and of which protrusions 3 are connected to edge surfaces of the upper and lower flanges of the beam 2 by butt welding. Ordinarily, the welding operation is carried out in a factory. The base plates of the fittings A connected to the beam 2 are brought into contact with the outer surface of the flange of the column 1 in position and bolted thereto in the field.

In case of connecting a beam to a web of a column, a fitting A is arranged in opposition to the beam as shown at the upper right hand and lower left hand in FIG. 4*a*, of which protrusion 3 and reinforcement 4 are connected to edge surfaces of the flange and web of the beam 2, respectively, by butt welding as shown in detail in FIGS. 6 and 7. The welding is usually effected in a factory.

A fitting B is then bolted in position to the web of the column 1 as shown at the center of FIG. 4*a*. The end of the lower flange of the beam 2 having the fitting A welded at the upper flange and the web is located on the supporting plate 11 of the fitting B bolted to the column 1 and is clamped thereto by means of bolts 13. The fitting A is bolted to the column 1 or is bolted to an adjacent fitting A through the column 1.

In the above embodiments, two fittings A are used for the upper and lower flanges of the beam without using the fitting B in a joint or one fitting A and one fitting B are used for the upper and lower flanges of the beam, respectively.

As an alternative, the fitting B may be used for the upper flange of the beam. The reinforcement 4 may not be welded to the web of the beam as the case may be.

In case of using the two fittings B in a joint, the supporting plate 11 of an upper fitting B is bolted to the upper flange of a beam and the base plate of a lower fitting B is bolted in position to a column. The end of the lower flange of the beam having at the upper flange the upper flange fitting B is brought onto the supporting plate of the lower fitting B. Thereafter the lower flange of the beam is bolted to the supporting plate of the lower fitting B and then the base plate of the upper fitting B is bolted to the column.

As a further alternative, two fittings B are previously bolted to the upper and lower flanges of the beam, respectively, in a factory. Thereafter, the beam having the two fittings B bolted thereto is connected to the column by bolting the base plates of the fittings B to the column.

It is to be understood that the fittings according to the invention are suitable not only to connect beams to flanges of columns but also to connect beams to webs of the columns.

The effects of the fittings according to the invention distinguishable over those of the prior art are as follows.

1. According to the invention the fitting is provided with the base plate which is thickest at the bottom of the horizontal protrusion and is tapered toward its opposite ends, so that it has a greatly higher yield strength against a bending moment in comparison with those of the prior art to improve the joint efficiency of the column and beam remarkably thereby obtaining a high rigidity at the connection thereof and improving a continuous beam effect.
2. In connection of H-shaped beams to a web of a column, fittings A for upper flanges of the beams are connected by welding to the beams 2 in a factory and fittings B for lower flanges of the beams are bolted in position to the column 1, on the horizontal plates of which fittings B are then located the lower flanges of the beams and bolted thereto, thereafter the fittings A are bolted to the column 1. Accordingly, a welding operation in field is not needed, so that the connection of the beams to the web of the column can be rapidly effected with ease.
3. According to the invention it is not required to provide horizontal stiffeners needed in the prior art as shown in FIG. 3 and therefore the column members are only subjected to drilling and cutting off operations without requiring any welding operation, so that working operations of a steel frame construction can be saved to one half to one third of those in the prior art. In addition, according to the invention there is no possibility of deformation of the members caused by welding, so that a steel frame construction with a high accuracy can be obtained.
4. The configuration of respective portions of the fittings according to the invention can be determined depending upon required stresses acting thereupon. Moreover, the fittings are favorable for mass-production by casting or drop-forging as a unitary body or a combination of rolling and welding or extruding and welding which serve to industrialize such building operations.
5. According to the invention the fittings having a high rigidity are connected to the webs of the columns to reinforce effectively the frame construction against the stresses acting onto panel zones between the columns when the frame construction is subjected to a horizontal force in the direction perpendicular to the surfaces of the flanges of the columns.
6. According to the invention the fittings B for the lower flanges of the beams are provided with the vertical reinforcement plates 12 which can be utilized as gusset plates for braces if desired.
7. According to the invention horizontal stiffeners for beams to be connected to the flanges of the column are not needed, so that the height of beams to be connected to the web of the column can be determined independently with that of beams to be connected to the flanges of the column.

It is understood by those skilled in the art that the forgoing description is preferred embodiments of the invention and that various changes and modifications may be made in the invention without departing from the spirit and scope thereof.

What is claimed is:

1. A method of connecting beams having an H-shaped section to a column having an H-shaped section of a steel frame construction by means of upper and lower flange fittings each comprising a substantially rectangular base plate to be connected to the column having centrally a continuous thicker portion from which the base plate is tapered toward opposite ends of the base plate, a supporting plate projecting from the thicker portion for supporting an upper flange of the beam and a reinforcement on the base plate forming a T-shaped portion with said supporting plate, characterized in comprising steps of securing said supporting plate of said upper flange fitting to one end of the upper flange of the beam in end-to-end relationship, bolting the base plate of said lower flange fitting in position to the column, placing one end of a lower flange of the beam onto said supporting plate of said lower flange fitting such that said base plate of the upper flange fitting secured to the upper flange of the beam is in contact with a surface of said column, securing the lower flange of the beam to the supporting plate of the lower flange fitting and bolting the base plate of the upper flange fitting to the surface of the column.

2. A method as set forth in claim 1, wherein said supporting plate of the lower flange fitting is secured to the lower flange of the beam by bolting to each other.

3. A method as set forth in claim 2, wherein said supporting plate of the upper flange fitting is secured to the upper flange of the beam by bolting to each other.

4. A method as set forth in claim 2, wherein the supporting plate of the upper flange fitting is secured to the upper flange of the beam by welding.

5. A method of connecting beams having an H-shaped section to a column having an H-shaped section of a steel frame construction, comprising steps of providing an upper flange fitting comprising protrusion in opposition to an upper flange and a web continual thereto of a said beam, a base plate tapered from a bottom of said protrusion in opposition to the flange of said beam toward upper and lower portions of the base plate and seats having holes for bolts formed in said base plate; welding said protrusions of said upper flange fitting to said upper flange and said web of said beams, respectively; providing a lower flange fitting comprising a horizontal plate formed with holes for bolts for supporting a lower flange of said beam thereon and bolted thereto, a vertical reinforcement plate under said horizontal plate, a base plate tapered from a bottom of said horizontal plate toward upper and lower portions of the base plate and seats having holes for bolts formed in said base plate; bolting said lower flange fitting in position to a web of said column; bringing the end of said beam having said upper flange fitting welded thereto to the web of said column such that said lower flange of said beam is located on said horizontal plate of said lower flange fitting and said base plate of said upper flange fitting is in contact with said web of said column; and bolting said lower flange of said beam to said horizontal plate of said lower flange fitting and said base plate of said upper flange fitting to said web of said column.

6. A method as set forth in claim 5, wherein further comprising steps of providing separate said upper flange fittings, welding said protrusions of one of said upper flange fitting to said upper flange and said web of a beam, welding said protrusions of the other of said upper flange fitting upside-down to said lower flange and said web of said beam, and bolting said base plates of these fittings in position to a flange of said column.

7. A method as set forth in claim 1, wherein the supporting plate of the lower flange fitting is secured to the lower flange of the beam by welding.

8. A method as set forth in claim 7, wherein the reinforcement of the lower flange fitting is secured to a web of the beam by welding.

9. A method as set forth in claim 7, wherein the supporting plate of the upper flange fitting is secured to the upper flange of the beam by welding.

* * * * *